United States Patent [19]

Reece

[11] 4,442,648

[45] Apr. 17, 1984

[54] CONCRETE PANEL

[76] Inventor: Chester A. Reece, 100 Bexhill Ct., Greenville, S.C. 29609

[21] Appl. No.: 292,786

[22] Filed: Aug. 14, 1981

[51] Int. Cl.[3] ..... E04C 1/34

[52] U.S. Cl. ..... 52/468; 52/471; 52/601

[58] Field of Search ..... 52/582, 466, 601, 459, 52/460, 468, 471

[56] References Cited

U.S. PATENT DOCUMENTS 2,703,003 3/1955 Ruppel .

3,555,763 1/1971 Bloxom ..... 52/601

4,152,878 5/1979 Balenski ..... 52/738

*Primary Examiner*—John E. Murtagh

*Assistant Examiner*—Kathryn L. Ford

*Attorney, Agent, or Firm*—Bailey & Hardaway

[57] ABSTRACT

Disclosed is a generally rectangular prefabricated concrete panel having a pair of edge defining members along each lateral edge with a maximum distance at the upper and lower extents of the panel, but with a concrete body portion having substantially parallel lateral edges with a width less than the minimum distance between the edge defining members.

10 Claims, 9 Drawing Figures

FIG. 1
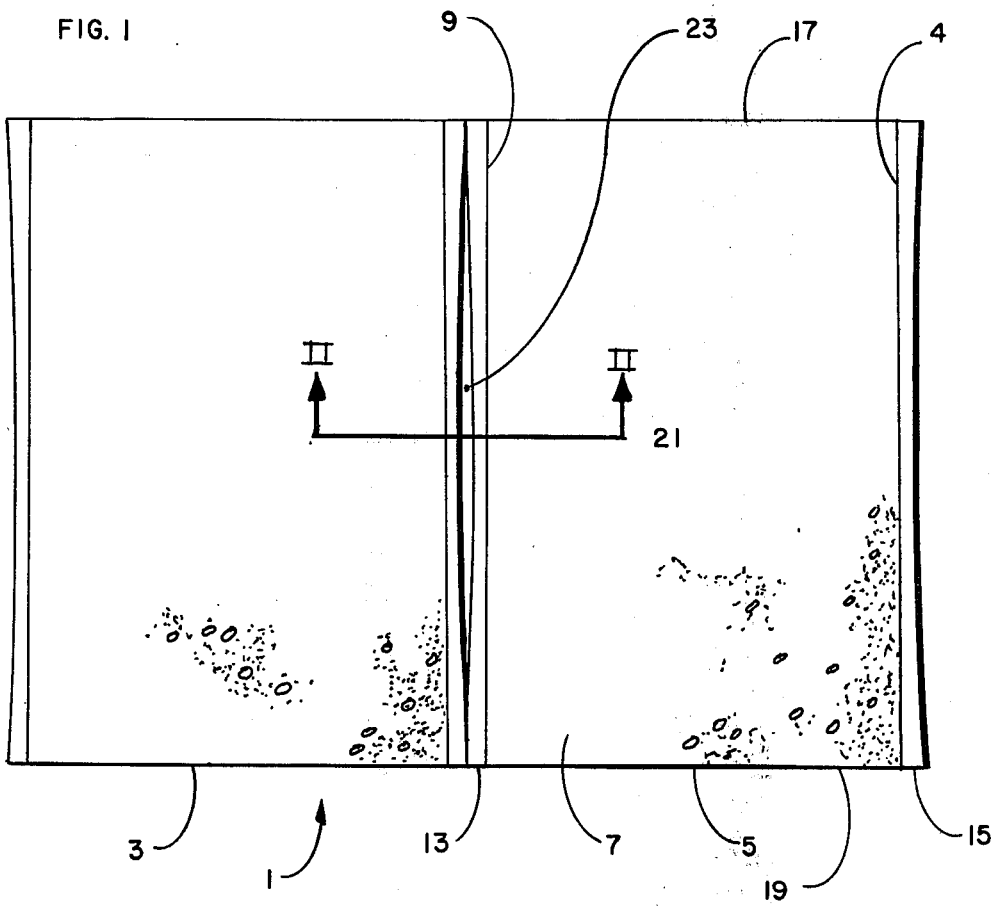
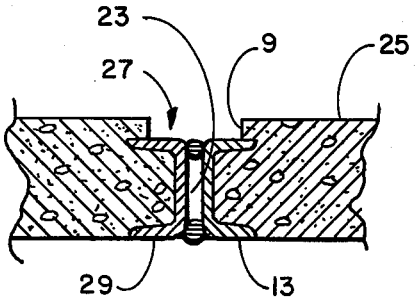
FIG. 2
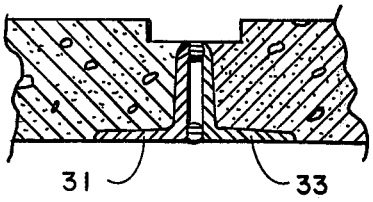
FIG. 3

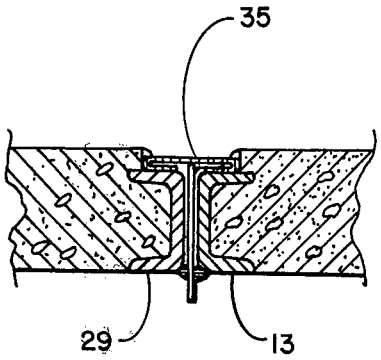
FIG. 4
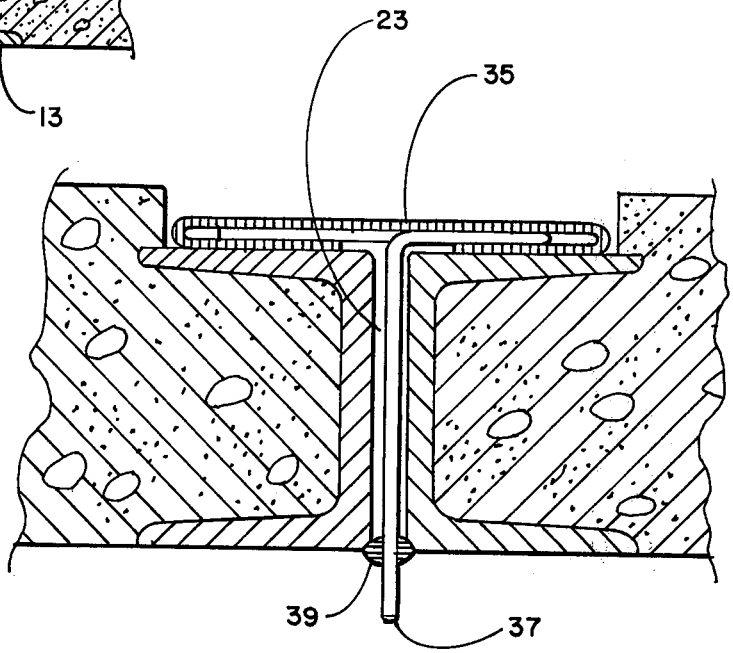
FIG. 5
FIG. 6
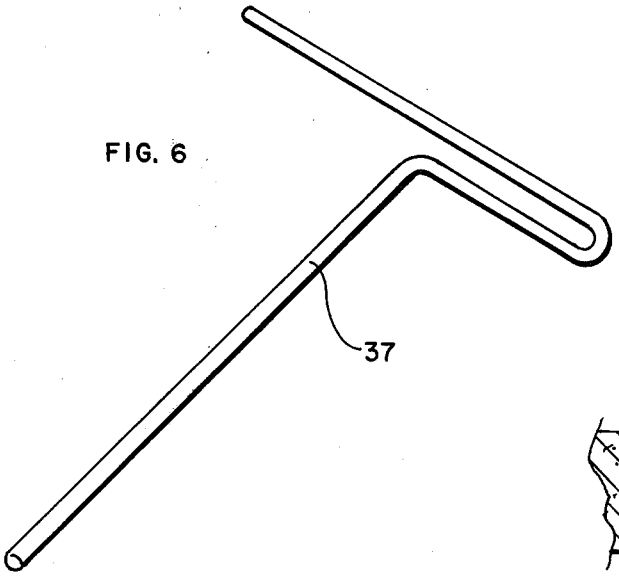
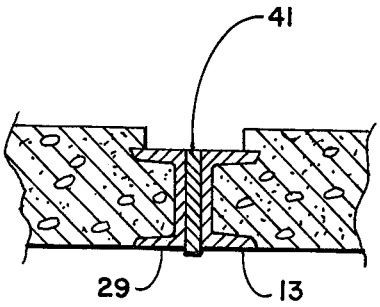
FIG. 7

CONCRETE PANEL

BACKGROUND OF THE INVENTION

This invention relates generally to the art of building construction, and, more particularly to a novel concrete building panel and the process of producing same.

Various prefabricated concrete panels exist within the prior art. Generally, the object of such prefabricated panels is to provide components to produce wall sections with the components being significantly larger than ordinary building bricks. Frequently such panels are large and cumbersome and must be produced on the site of the actusl construction, so as to minimize the problems associated with transport.

One technique of on site production is disclosed in U.S. Pat. No. 4,104,356 Deutsch et al, wherein reuseable brackets are utilized for securing wood forms for tilt up panels. Such panels are produced on site, and merely tilted from the horizontal casting position into the vertical use position. The concrete panels so prepared are cast adjacent a foundation so that the step of tilting normally results in the panel being placed directly upon the foundation supporting the desired wall structure.

Another prior art prefabricated panel is disclosed in U.S. Pat. No. 3,609,935 to Thomas. Thomas also describes a form for use in producing tilt up concrete modules. A complex overlap joint structure utilizing a special joint element is disclosed by Thomas.

Another technique of adjoining adjacent panels is disclosed in U.S. Pat. No. 2,462,415 to Nagel wherein spline forming locking plates are utilized to join adjacent panels.

U.S. Pat. No. 4,059,939 to Elliott discloses a prefabricated panel comprising an exterior wall of concrete with the concrete being poured over reinforcing bars which extend from one panel to another. The reinforcing bars of one panel are welded to the reinforcing bars of an adjacent panel and a pilaster is poured over the joined reinforcing bars to complete the wall structure.

U.S. Pat. No. 2,703,003 to Ruppel discloses a prefabricated panel having a mechanical interlock arrangement between adjacent panels.

U.S. Pat. No. 3,555,763 to Bloxom discloses a prefabricated lightweight concrete panel having metallic edge defining members about the entire periphery of the panel. The edge defining members are joined together with reinforcing bars between opposite sides with the central reinforcing bars being sufficiently tensioned to effect a width decrease in the central portion of the panel. In effect, the outer channel iron is bowed in the central portion of the panel. A resulting panel when in the vertical position has a decreased width approximately in the midpoint of its vertical extent. The upper and lower extremities of this panel then have a maximum width near the upper and lower corners. This construction facilitates dimensional control when joining a series of panels since the outside dimensions of each panel are determined by the dimensions at the upper and lower extremities of the panel. Bloxom discloses additional embodiments wherein the gap between adjacent edge defining members is filled with a fiberglass composition.

Bloxom additionally discloses an embodiment wherein angle iron is utilized as a temporary form by tack welding the angle iron to the channel iron edge defining members prior to effecting the width change.

After casting, the temporary angle iron structure is removed by breaking the tack weld. The resulting panel has a recessed area which is vertically disposed on a resulting wall between the concrete surface and the exposed channel iron. This recessed area may be covered with a metallic strip which is tack welded to one of the channel iron edge defining members.

While the above discussed prior art produces concrete panels suitable for many applications, many problems have remained unrecognized and unsolved within the prior art.

SUMMARY OF THE INVENTION

It is thus an object of this invention to provide a novel concrete building panel.

It is a further object of this invention to provide a novel concrete building panel having lateral edges which have a maximum width at the upper and lower extremities thereof but having a concrete body portion with substantially parallel lateral edges.

It is a further object of this invention to provide a concrete building panel which may be assembled with similar panels to expose adjacent concrete body portions with substantially parallel lateral edges.

It is a still further object of this invention to provide such adjacent panels which may have adjacent edge defining members covered with a substantially rectangular strip whereby no deviation from a substantially rectangular shape is apparent on the exterior wall surface.

It is a further and more particular object of this invention to provide a process of forming such panels.

It is a still further amd more particular object of this invention to provide a process of producing a pluraltiy of such panels in a single operation.

These as well as other objects are accomplished by disposing a plurality of edge defining members upon a casting surface with the edge defining members of one panel being alongside the edge defining member of an adjacent panel, spacing adjacent edge defining members to produce a distance between the outer edges of the edge defining members of a single panel which is a maximum at the upper and lower extents thereof and a minimum at the midpoint thereof, placing concrete body lateral edge formers in vertical contact with said edge defining members and casting concrete between said edge defining members and said concrete body lateral edge formers, permitting the concrete to harden removing the concrete body lateral edge formers to produce a concrete panel having a concrete body portion with substantially parallel lateral edges and edge defining members along the outer lateral edge of each panel with a maximum width distance at the upper and lower extents of the panel.

BRIEF DESCRIPTION OF THE DRAWINGS

FIG. 1 illustrates adjacent concrete panels within a wall structure.

FIG. 2 of the drawings is a view along the line 2—2 of FIG. 1.

FIG. 3 of the drawings is a view similar to FIG. 2 but illustrating different edge defining members.

FIG. 4 of the drawings is a view similar to FIG. 2 of the drawings illustrating an additional embodiment.

FIG. 5 of the drawings is a blow-up of the view in FIG. 4.

FIG. 6 of the drawings illustrates a wire clip for utilization in the FIG. 4 and 5 embodiment.

FIG. 7 of the drawings is a view similar to FIG. 2 of the drawings illustrating a metallic reinforcement plate between adjacent edge defining members.

DETAILED DESCRIPTION

Figure 8:
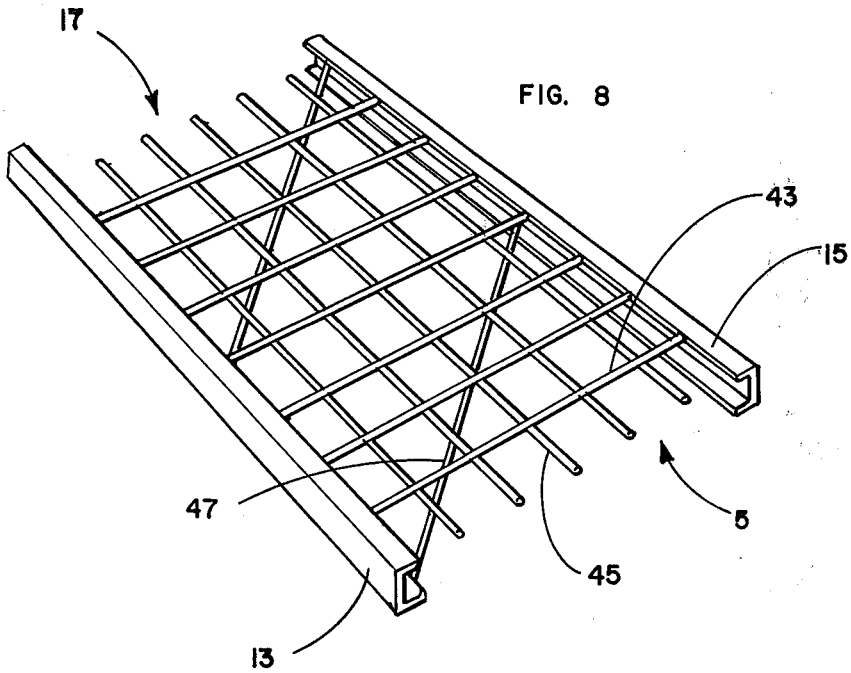
FIG. 8 of the drawings illustrates a skeletal frame for utilization in producing a concrete panel in accordance with this invention.

In accordance with this invention, it has been found that a concrete panel may be formed having edge defining members which produce an outer width dimension which is a maximum at the lower and upper extents of the panel, but which has a concrete body portion of substantially uniform width so as to expose a surface without a bowed appearance.

It has been further found that such panels may be produced in a process wherein a plurality of panels are simultaneously produced so as to have adjacent panels cast alongside one another. An unexpected advantage of such a casting process is that any dimensional irregularities in an individual panel are compensated for since that panel is cast alongside the panel against which it will be adjacently disposed in a completed wall. Thus an entire wall section may be cast in a manner so as to exercise dimensional control over the overall wall with individual panel irregularities being self-compensating. An additional advantageous feature of the instant invention is the need for metallic edge defining members only along the lateral edges rather than the top and bottom portions of the panel. In this way, the rust and corrosion normally associated with upper and lower edge defining members is eliminated. Further description of the invention will be given with reference to the various Figures of drawing.

FIG. 1 of the drawings illustrates a pair of adjacent panels 1 comprising individual concrete panels 3 and 5. Individual panel 5 as does individual panel 3 comprises a concrete body portion 7 with substantially parallel lateral edges 9 and 11. The lateral edges of the panel are defined by edge defining members 13 and 15.

The edge defining members 13 and 15 along the lateral edges of the panel define with their outer dimensions the outer dimensions of the overall panel. The overall panel is referred to as being generally rectangular, however, the width of the panel is a maximum at its upper extent 17 and lower extent 19. The panel thus has a minimum width in the mid-portion 21. This minimum dimension produces a gap 23 between adjacent panels. The width of this gap may be from about $\frac{1}{2}$ to about $\frac{3}{8}$ inch, depending on the overall height of the entire panel. The gap 23 shown in FIG. 1 is thus exaggerated for purposes of explanation.

FIG. 2 of the drawings is a view along line 2—2 of FIG. 1. As is shown in FIG. 2, the exposed surface 25 reveals a recess 27 between the edge defining member 9 and the exposed surface 25. The recess 27 is bordered by substantially parallel lateral edges of concrete body portions but exposes a contact between adjacent edge defining members 13 and 29 which is bowed in the mid-point due to the gap 23.

while FIGS. 1 and 2 show edge defining members formed of channel iron, FIG. 3 shows a view similar to FIG. 2 wherein the edge defining members are formed of angle iron 31 and 33. Adjacent panels in either embodiment are preferably welded to one another along the metallic edge defining members. It should be noted that when channel iron is juxtaposed and welded a column is formed. This column gives structural strength and rigidity to the overall structure.

The size and gauge of the edge defining members may be varied in order to carry superimposed loads such as roofs, floors, etc. Where the concrete panels will be used as a veneer or facade such as in retrofitting existing structures, the edge defining members need only be of sufficient size and weight to form the panel and provide support during the lifting or tilting of the panel. Such a panel would be a non-load bearing panel.

An advantage of the instant invention is that adjacent edge defining members may be covered with a generally rectangular strip to give a batten effect. This aspect of the invention is generally shown in FIG. 4 of the drawings wherein adjacent edge defining members 13 and 29 are covered on the exposed surface with a rectangular metallic strip 35 to give a batten effect without exposing the bowed mid-portion of the panel, but while retaining the advantageous dimensional control provided by such a structure.

A more detailed view of rectangular strip 35 is shown in FIG. 5 of the drawings. A preferred aspect embodied in the use of rectangular strip 35 is that a simple wire clip 37 passes through the gap 23 to be welded to the unexposed surface of the edge defining members. Due to the method of attachment, rectangular strip 35 will not tend to deform with movement of the panels during the normal weathering process.

The exterior surface of rectangular strip 35 appears to the observer as a part of an overall square cornered structure with the rectangular strip 35 lying between generally parallel lateral edges of concrete body portions. There is thus no exterior visibility of the bowing of edge defining members brought about by gap 23.

The wire clip 37 is shown in greater detail in FIG. 6. The tail portion of the clip is generally pulled through the gap 23 to be spot welded to the opposite side and then clipped or otherwise removed from view. A spot weld 39 is illustrated in FIG. 5 of the drawings.

It is understood that the gap 23 will be filled with conventional caulking material such as silicone or polysulfide based materials.

Another advantageous aspect of this invention is illustrated in FIG. 7 of the drawings wherein a steel plate 41 is disposed between adjacent edge defining members to produce a strengthened column brought about be welding the plate 41 to the edge defining members 29 and 13. Plate 41 may be generally flat iron having a thickness from $\frac{1}{4}$ to $\frac{1}{2}$ inch. Plate 41 may be utilized alone or in combination with the rectangular strip 35.

FIG. 8 of the drawings shows a general skeletal structure for an individual panel 5 in accordance with this invention. Such structure generally comprises the edge defining members 13 and 15 and may have reinforcing bars 43 and 45 extending throughout the interior of the structure for the purpose of reinforcement. As will be more apparent from the process description below, horizontal reinforcing bars 43 are attached to only one edge defining member so as to permit dimension adjustment in accordance with this invention. Preferably every other horizontal reinforcing bar 43 is attached to one edge defining member while the remaining horizontal reinforcing bars 43 are attached to the other edge defining members. The panel may have welding surfaces exposed at locations where it is desired to expose a metallic element for purposes of providing a weld point. Such weld surfaces for example may be exposed in the central section of the uppermost portion 17. Such weld plates or surfaces facilitate attachment to a roof or other overhead structure.

Additionally diagonal reinforcement 47 may be utilized when the height of the panel so dictates. Generally a panel in accordance with this invention will have a height of 10 to 12 feet with a gap 23 at the minimum dimension of approximatley ½inch. Diagonal reinforcement rods may be utilized with such a height. Heights greater than 12 feet may require additional diagonal reinforcement. Diagonal reinforcement bars additionally help maintain the edge defining members in a generally straight relationship until the concrete is in place.

The process of producing the novel concrete panel in accordance with this invention is preferably carried out by casting a plurality of panels simultaneously in a side by side relationship. While edge defining members are utilized to define a portion of each lateral edge, the upper and lower edges of the panels produced in accordance with this invention are produced utilizing vertical forms which do not form a part of the resulting panel. Thus the process of this invention is carried out by disposing a plurality of edge defining members upon a casting surface bordered by upper and lower mold sections which define vertical casting surfaces. The edge defining members are arranged in a parallel relationship with edge defining members of one panel being alongside edge defining members of adjacent panels. The spacing between adjacent edge defining members is adjusted to produce a distance between the outer edges of the edge defining members of a single panel which is a maximum at the upper and lower extents of the overall panel, and thus a minimum at the mid-portion thereof. After establishing that spacing, any desired reinforcing rods or welding surfaces are added to the space between edge defining members of a single panel and attached thereto as is desired. Concrete body lateral edge formers are placed over the edge defining members in a generally parallel relationship to define the recess and parallel lateral edges of the concrete body portion.

Figure 9:
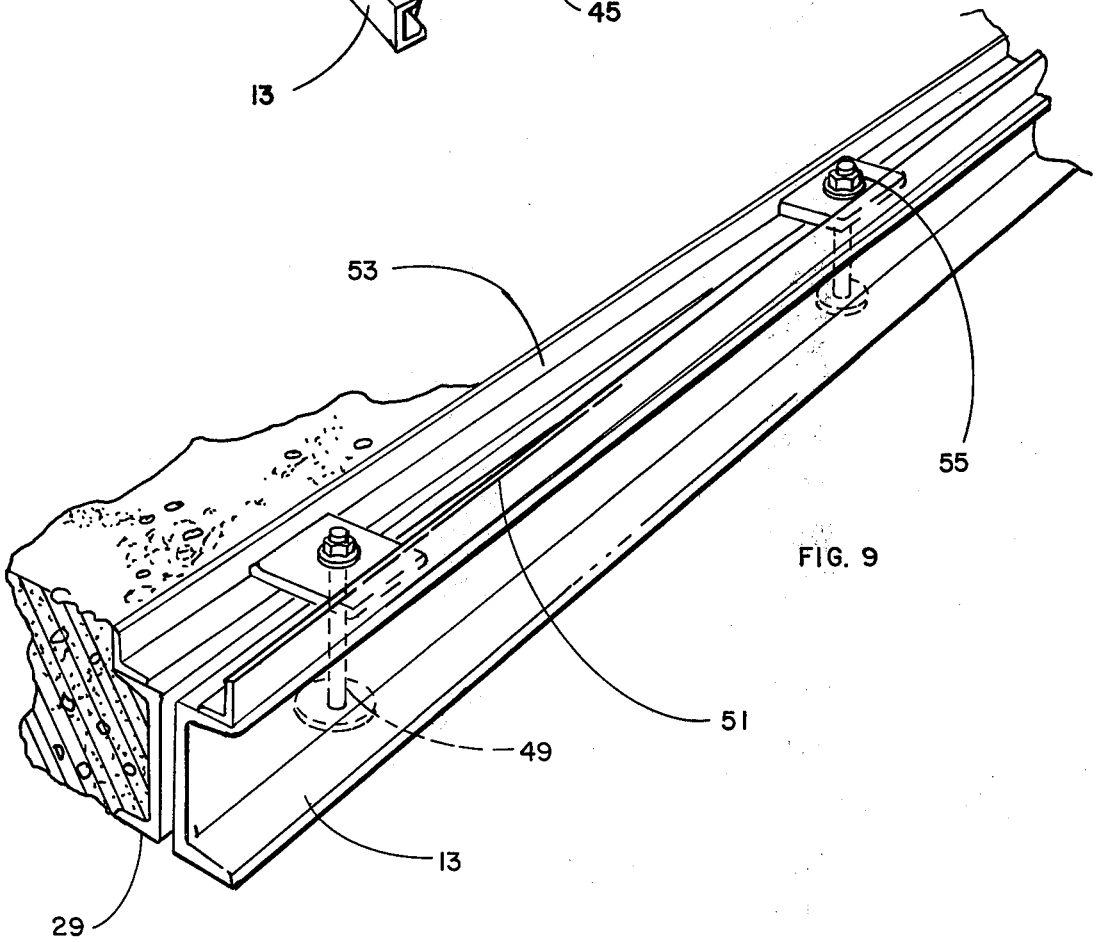
FIG. 9 of the drawings illustrates a mullion between adjacent edge defining members in carrying out the process of this invention.

The process of this invention may be better understood by referring to FIG. 9 of the drawings which illustrates a preferred process in accordance with this invention. FIG. 9 of the drawings shows adjacent defining members 29 and 13 separated by mullion 49 which in this instance is a bolt attached to concrete body lateral edge formers 51 and 53. Thus a plurality of edge defining members are positioned with a mullion 49 between adjacent lateral edge defining members. After accurately spacing the edge defining members the midportion of the edge defining members is shimmed to create a bowing effect therein. The shimming produces a maximum dimension for a single panel at the outer edges of the edge defining members which is a maximum at the upper and lower extents of a single panel and a minimum at the midportion thereof. Bolts forming mullion 49 are attached to concrete body lateral edge formers 51 and 53 by nut 55. The edge formers are substantially straight to form parallel lateral edges on the concrete body portion. While the formers 51 and 53 are shown as being angle iron at 90 degrees, it is understood that the recess may be formed with any desired angle or surface geometry, so long as the concrete body portion exhibits parallel edges. For example, the angle iron 51 and 53 could be substantially at an angle of 135 degrees so as to produce a truncated recess between adjacent panels.

After the concrete lateral edge formers have been secured to mullion 49, concrete is cast into the void structure defined by temporary upper and lower molds, edge defining members and concrete lateral edge formers. Upon setting of the concrete, the concrete body lateral edge formers are removed to free the resulting panels for use in any desired manner. While the description given herein is with reference to lateral edge formers positioned atop edge defining members, it is readily apparent that the positions can be reversed to have the edge defining members positioned atop the lateral edge formers. Such positioning is desirable when the casting surface is provided with a pattern to be transferred to the panel exposed surface.

An advantage of producing a pluraltiy of panels in side by side relationship is that each panel is cast alongside the panel against which it will reside in an adjacent relationship within a wall structure. Any irregularities in an individual panel tend to be compensated for by its relationship with the adjacent panel. Thus an entire wall structure may be cast at one time, with the overall dimensions of the wall structure being controlled and any individual panel irregularities being self-compensating.

An advantageous feature of the instant invention is the non-attachment of the lateral edge formers to the edge defining members. While the prior art attached lateral edge formers to an edge defining member, such prior art techniques resulted in lateral edges within a concrete body portions which followed all of the meanderings of the edge defining members and resulted in loss of aesthetic appeal.

Another disadvantage of the prior art technique wherein lateral edge formers are attached to edge defining members is the deleterious effect which numerous and repeated spot welds have upon lateral edge formers. The process of the current invention produces concrete body portions with lateral edges which are independent of the irregularities existing within the edge defining members. The lateral edge formers utilized within the process of this invention are additionally not subjected to the deleterious effects of numerous and repeated spot welds and the breaking thereof.

It is understood that many conventional aspects of precast panel manufacture may be incorporated into the process of producing the panels of this invention. Such may include the use of parting materials or the addition of formers within the mold structure to define windows or doors or openings for electrical and plumbing connections.

An unexpected and advantageous feature of the instant invention is the use of decorative enhancement of the exposed surface of the panel. For example, the exposed surface may be scored to give the appearance of rectangular blocks. Such scoring or scribing without the substantially parallel lateral edges in the concrete body portion tend to accentuate the bowing of that portion.

This advantage also exists for inlaid brick within the panel surface. Thus with this invention it is possible to have regular geometric patterns on the exposed surface of the panel without accentuating bowed panel edges, since the panel of this invention has concrete body portions which have no bowing.

It is additionally contemplated that brick or stone may be placed upon the exposed surface. The regular geometry of brick or stone will readily blend with the straight parallel lateral edges of the concrete body portion rather than accentuate or bow as occurs within the prior art.

An advantage of the panel in accordance with this invention is that not only may the panels be utilized in new structures, but also for retrofitting existing structures. With the advent of increased energy prices, it has become imperative that structures be adequately insulated. Many older structures are not. The panels of this invention may be utilized to form a facade upon an existing structure, while trapping a layer of insulation between the panel and the existing structure.

It is thus seen that in accordance with this invention, a unique panel has been provided having edge defining members which have a maximum dimension at the upper and lower extents of the panel and a minimum dimension in the midportion of the panel. The panel of this invention provides such a structure while simultaneously providing a panel with a concrete body portion having substantially parallel lateral edges so as to expose a generally square cornered structure to the eye of the viewer, particularly when the rectangular strip in accordance with this invention is utilized to achieve a batten effect. It is further seen that the process of this invention provides a novel method of forming concrete panels. The process of this invention provides a concrete body lateral edge former which need not be welded to the lateral edge defining members during the casting process. Additionally the process of this invention provides for the simultaneous casting of a plurality of panels in side by side relationship whereby overall dimensional tolerance may be controlled and with any individual panel irregularities being self-compensating and not transferrable to concrete body lateral edge formers.

Having described the panel and process of producing same, many variations thereof will become apparent to those skilled in the art. Such variations, however, are embodied within the scope of this invention as defined by the following appended claims.

That which is claimed is:

1. A generally rectangular concrete panel comprising;

a concrete body portion;

a pair of curved edge defining members along each lateral edge of said panel, said edge defining member being curved such that the distance between the outer edges of said edge defining members are a maximum at the upper and lower extents of said panel and a mimimum at the mid-portion of said panel; and wherein said concrete body portion has substantially straight parallel edges with a width less than said minimum distance between said edge defining members.

2. The concrete panel in accordance with claim 1 wherein a wall formed of said panels has adjacent panels which abut one another along the edges defined by said edge defining members at said maximum distance and wherein lateral edges of said concrete body portion of adjacent panels have generally straight parallel edges.

3. The concrete panel in accordance with claim 2 wherein adjacent panels define a gap between adjacent edge defining members at said minimum distance.

4. The concrete panel in accordance with claim 3 further comprising a rectangular strip overlying adjacent edge defining members to cover said gap.

5. The concrete panel in accordance with claim 4 wherein said strip is attached to adjacent edge defining members on the opposite side of said edge defining members from the side covered by said strip.

6. The concrete panel in accordance with claim 5 wherein said rectangular strip further comprises attachment means on the surface thereof facing said gap for extending through said gap to attach to said opposite side of said adjacent edge defining members.

7. The concrete panel in accordance with claim 1 wherein said edge defining members comprise angel iron.

8. The concrete panel in accordance with claim 1 wherein said edge defining members comprise channel iron.

9. A wall formed of a plurality of said generally rectangular concrete panels of claim 1 with adjacent panels abutted at said maximum distance and welded together by welds between adjacent edge defining members.

10. The wall in accordance with claim 9 further comprising a plate of reinforcing steel between adjacent edge defining members, said plate being welded to adjacent edge defining members.

* * * * *